US009845807B2

(12) United States Patent
Takeda et al.

(10) Patent No.: US 9,845,807 B2
(45) Date of Patent: Dec. 19, 2017

(54) COMPRESSOR CONTROL DEVICE, COMPRESSOR SYSTEM AND COMPRESSOR CONTROL METHOD

(71) Applicants: MITSUBISHI HEAVY INDUSTRIES COMPRESSOR CORPORATION, Tokyo (JP); MITSUBISHI HEAVY INDUSTRIES, LTD., Tokyo (JP)

(72) Inventors: Kazuhiro Takeda, Tokyo (JP); Yosuke Nakagawa, Tokyo (JP)

(73) Assignees: MITSUBISHI HEAVY INDUSTRIES COMPRESSOR CORPORATION, Tokyo (JP); MITSUBISHI HEAVY INDUSTRIES, LTD., Tokyo (JP)

( * ) Notice: Subject to any disclaimer, the term of this patent is extended or adjusted under 35 U.S.C. 154(b) by 446 days.

(21) Appl. No.: 14/408,233

(22) PCT Filed: Sep. 12, 2013

(86) PCT No.: PCT/JP2013/074739

§ 371 (c)(1),
(2) Date: Dec. 15, 2014

(87) PCT Pub. No.: WO2014/087712

PCT Pub. Date: Jun. 12, 2014

(65) Prior Publication Data

US 2015/0139776 A1 May 21, 2015

(30) Foreign Application Priority Data

Dec. 4, 2012 (JP) ..... 2012-265642

(51) Int. Cl.
*F04D 27/02* (2006.01)
*F04D 25/16* (2006.01)
*F04D 27/00* (2006.01)

(52) U.S. Cl.
CPC ..... *F04D 27/0269* (2013.01); *F04D 25/16* (2013.01); *F04D 27/001* (2013.01);
(Continued)

(58) Field of Classification Search
CPC ..... F04D 27/0269; F05D 2250/90
See application file for complete search history.

(56) References Cited

U.S. PATENT DOCUMENTS 4,560,319 A 12/1985 Blotenberg
5,743,714 A * 4/1998 Drob ..... F04D 27/0261 415/1

(Continued)

FOREIGN PATENT DOCUMENTS

CN 101454576 A 6/2009
CN 101842599 A 9/2010

(Continued)

OTHER PUBLICATIONS

Extended European Search Report dated Jul. 11, 2016 in Counterpart EP Application No. 13861200.7.

(Continued)

*Primary Examiner* — Gregory Anderson
*Assistant Examiner* — Jason Davis
(74) *Attorney, Agent, or Firm* — Birch, Stewart, Kolasch & Birch, LLP

(57) ABSTRACT

Provided is a compressor control device configured to control a flow rate of a compressor having a plurality of impellers connected to an outlet port-side flow path in parallel and a flow rate regulation unit configured to regulate a flow rate of each of the impellers, the compressor control device including a pressure detection unit configured to detect a pressure of the outlet port-side flow path, a flow rate detection unit configured to detect the flow rate of each of the impellers, and a control unit configured to output a flow rate regulation command of each of the impellers to the flow rate regulation unit and control the flow rate regulation unit based on the detection result of the pressure detection unit.

6 Claims, 13 Drawing Sheets

(52) U.S. Cl.
CPC ..... *F04D 27/0223* (2013.01); *F04D 27/0246* (2013.01); *F04D 27/0253* (2013.01); *F04D 27/004* (2013.01)

(56) References Cited

U.S. PATENT DOCUMENTS

| | | | | |
|---|---|---|---|---|
| 2003/0063981 | A1* | 4/2003 | Saxena | F01D 15/08 417/286 |
| 2010/0024456 | A1 | 2/2010 | Ueda et al. | |
| 2010/0178154 | A1 | 7/2010 | Dirks et al. | |
| 2011/0048046 | A1 | 3/2011 | Sommer et al. | |

FOREIGN PATENT DOCUMENTS

| | | | |
|---|---|---|---|
| CN | 102518598 | A | 6/2012 |
| EP | 0 500 195 | A2 | 8/1992 |
| JP | 61-201900 | A | 9/1986 |
| JP | 6-88597 | A | 3/1994 |
| JP | 2012-202336 | A | 10/2012 |
| JP | 2013-170573 | A | 9/2013 |

OTHER PUBLICATIONS

International Search Report, issued in PCT/JP2013/074739, dated Oct. 15, 2013.
Written Opinion of the International Searching Authority, issued in PCT/JP2013/074739, dated Oct. 15, 2013.

* cited by examiner

COMPRESSOR CONTROL DEVICE, COMPRESSOR SYSTEM AND COMPRESSOR CONTROL METHOD

TECHNICAL FIELD

The present invention relates to a compressor control device, a compressor system and a compressor control method.

Priority is claimed on Japanese Patent Application No. 2012-265642, filed Dec. 4, 2012, the content of which is incorporated herein by reference.

BACKGROUND ART

A compressor configured to compress a gas and supply the compressed gas to a machine or the like connected to a downstream side thereof is known. As such a compressor, there is a compressor that can control a flow rate. For example, a compressor system includes an inlet guide vane of the compressor installed at an upstream side of an impeller, and introduces a gas to the impeller via the inlet guide vane. Then, the compressor system controls the flow rate of the gas introduced into the impeller by regulating an opening of the inlet guide vane.

In addition, the compressor system may include a multi-stage impeller from an upstream side toward a downstream side of a gas flow (for example, see Patent Literature 1). Further, in order to increase a flow rate, there is a compressor system including a plurality of impellers installed at the most upstream side, and configured to join the gas compressed by the plurality of impellers and then introduce the gas into the impeller of the downstream side. In such a compressor system, there is a method of controlling an introduction flow rate to the plurality of impellers connected to the most upstream side in parallel at the same period of the opening degrees of the inlet guide vanes disposed at the upstream side of the impeller (i.e., the opening degrees become equal to each other) and controlling a state of the ejected gas. For example, the compressor system includes the inlet guide vanes installed at the inlet ports of the plurality of impellers at the most upstream side. Then, the compressor system controls the opening degrees of the inlet guide vane to be equal to each other, and controls a state of the ejected gas.

CITATION LIST

Patent Literature

[Patent Literature 1] Japanese Unexamined Patent Application, First Publication No. H06-88597

SUMMARY OF INVENTION

Technical Problem

In the method of controlling the opening degrees of the inlet guide vanes disposed at the upstream side of the plurality of impellers to be equal to each other and controlling the flow rate in the impeller, when a performance difference is generated between the plurality of impellers due to an individual difference, deterioration with age, or the like, the opening degrees of the inlet guide vanes need to be controlled with reference to the impeller in which performance has decreased. For this reason, in this method, an operable range may be narrowed. In particular, since a flow rate in the impeller in which performance has deteriorated is decreased and approaches the surge region, anti-surge control for protecting the compressor by opening a blowoff valve is considered. In this case, even when there is no need to open the blowoff valve at another impeller, the blowoff valve is opened and a gas flow rate of the compressor is increased, and thus a power need is increased, thereby decreasing efficiency.

The present invention provides a compressor control device, a compressor system and a compressor control method that are capable of reducing a decrease in efficiency even when a performance difference is generated between a plurality of impellers.

Solution to Problem

According to a first aspect of the present invention, a compressor control device configured to control a flow rate of a compressor having a plurality of impellers connected to an outlet port-side flow path in parallel and a flow rate regulation unit configured to regulate the flow rate of each of the impellers, the compressor control device includes a pressure detection unit configured to detect a pressure of the outlet port-side flow path, a flow rate detection unit configured to detect the flow rate of each of the impellers, and a control unit configured to output a flow rate regulation command of each of the impellers to the flow rate regulation unit and control the flow rate regulation unit based on the detection result of the pressure detection unit. The control unit compares a set point set as a lower limit target value of a flow rate with the flow rate of each of the impellers, and corrects a flow rate regulation command of another impeller based on the comparison result.

In addition, according to a second aspect of the present invention, in the above-mentioned compressor control device, when a flow rate of a certain impeller is smaller than the set point, the control unit controls the flow rate regulation unit to fix the flow rate of the impeller.

In addition, according to a third aspect of the present invention, in the above-mentioned compressor control device, the control unit releases the fixing of the flow rate of the impeller when the set point apart from the flow rate command value more than a predetermined value.

In addition, according to a fourth aspect of the present invention, the control unit releases the fixing of the flow rate of the impeller when the flow rate of all of impellers is smaller than the set point.

In addition, according to a fifth aspect of the present invention, in the above-mentioned compressor control device, the pressure detection unit detects a pressure of an inlet port-side flow path, and the control unit outputs the flow rate regulation command based on the pressure of the inlet port-side flow path.

In addition, according to a sixth aspect of the present invention, a compressor system includes any one of the above-mentioned compressor control devices.

In addition, according to a seventh aspect of the present invention, a compressor control method of a compressor control device configured to control a flow rate of a compressor having a plurality of impellers connected to an outlet port-side flow path in parallel, the compressor control method includes a pressure detection step of detecting a pressure of the outlet port-side flow path, a flow rate detection step of detecting a flow rate of each of the impellers, a flow rate regulation step of regulating the flow rate of each of the impellers, and a control step of outputting a flow rate regulation command of each of the impellers in the flow rate regulation step to control the flow rate regulation step based on the detection result in the pressure detection step, wherein, in the control step, a set point set as a lower limit target value of a flow rate and the flow rate of each of the impellers are compared, and a flow rate regulation command of another impeller is corrected based on the comparison result.

Advantageous Effects of Invention

According to the above-mentioned compressor control device, compressor system and compressor control method, even when a performance difference is generated between the plurality of impellers, a decrease in efficiency can be reduced.

DESCRIPTION OF EMBODIMENTS

Hereinafter, while the present invention is described through embodiments of the present invention, the following embodiments do not limit the invention related to the scope of the claims. In addition, not all combinations of features described in the embodiments are necessary for the solutions of the present invention.

First Embodiment

Figure 1:
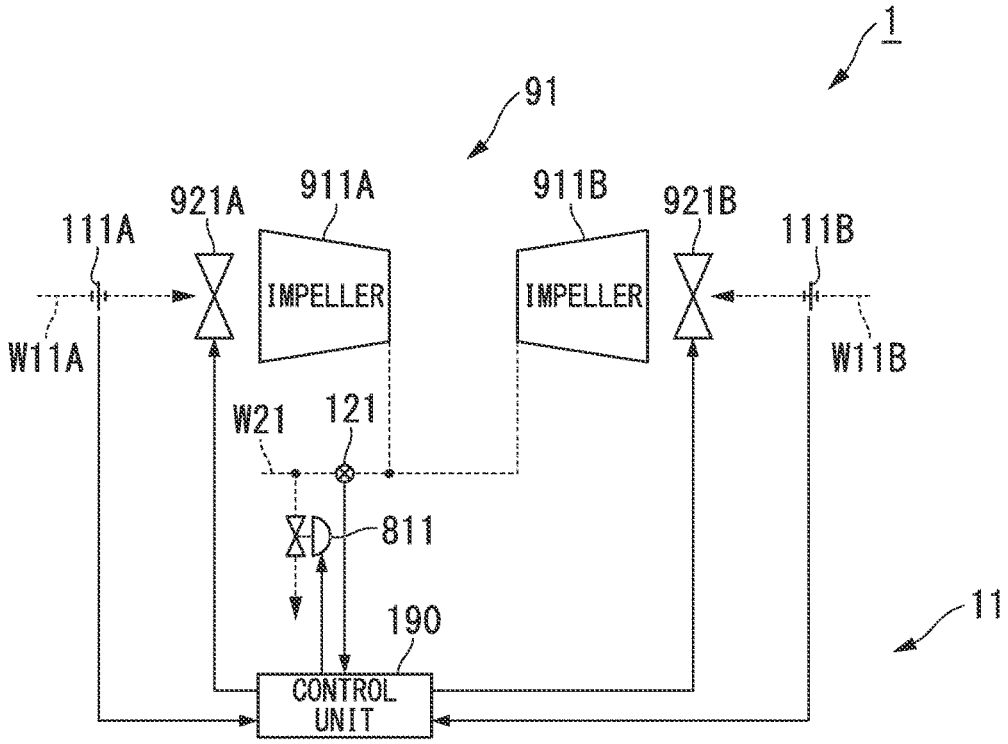
FIG. 1 is a schematic configuration view showing a configuration of a compressor system according to a first embodiment of the present invention.

FIG. 1 is a schematic configuration view showing a configuration of a compressor system according to a first embodiment of the present invention. In FIG. 1, a compressor system 1 includes a compressor control device 11, a compressor 91 and a blowoff valve 811. The compressor control device 11 includes flow rate sensors 111A and 111B, a pressure sensor 121 and a control unit 190. The compressor 91 includes impellers 911A and 911B, and inlet guide vanes (IGV) 921A and 921B.

The compressor 91 suctions and compresses air, and supplies the compressed air into an instrument disposed downstream from the compressor 91 using the compressed air (hereinafter referred to as "a lower process").

However, a compression target compressed by the compressor 91 is not limited to air. For example, various compressible gases such as a gaseous coolant or the like may be the compression target.

The impellers 911A and 911B are connected to an outlet port-side flow path W21 in parallel, compress the air introduced from inlet port-side flow paths W11A and W11B via the impellers 911A and 911B and output the compressed air to the outlet port-side flow path W21. However, the number of impellers included in the compressor 91 is not limited to the two shown in FIG. 1 but may be three or more.

The inlet guide vanes (IGV) 921A and 921B correspond to one example of a flow rate regulation unit in the embodiment, and regulate a flow rate of each of the impellers. More specifically, the inlet guide vanes 921A and 921B are installed at inlet port-sides of the impellers 911A and 911B, and regulate the flow rates of the impellers 911A and 911B by regulating an IGV opening degree, which is a blade opening degree thereof. However, the flow rate regulation unit according to the embodiment is not limited to the inlet guide vane. For example, the flow rate regulation unit may be a driving rotator installed at each of the impellers 911A and 911B, and configured to regulate the flow rate by regulating a speed of the impeller 911A or 911B.

In addition, while the case in which the flow rate of the inlet port side of the impeller is used as the flow rate of the impeller will be described in the following description, a flow rate of an outlet port side of the impeller may be used as the flow rate of the impeller.

The compressor control device 11 controls a flow rate of the compressor 91 based on the flow rate or the measurement value of the pressure in the compressor 91.

The flow rate sensor 111A detects the flow rate of the impeller 911A installed at the inlet port-side flow path W11A. The flow rate sensor 111B detects the flow rate of the impeller 911B installed at the inlet port-side flow path W11B. The flow rate sensors 111A and 111B correspond to an example of the flow rate detection unit according to the embodiment.

However, the flow rate detection unit according to the embodiment is not limited to the flow rate sensor. For example, the flow rate detection unit may be a receiving circuit configured to receive sensing data transmitted from the flow rate sensor.

The pressure sensor 121 detects a pressure of the outlet port-side flow path W21 installed at the outlet port-side flow path W21. The pressure sensor 121 corresponds to one example of the pressure detection unit according to the embodiment.

However, the pressure detection unit according to the embodiment is not limited to the pressure sensor. For example, the pressure detection unit may be a receiving circuit configured to receive sensing data transmitted from the pressure sensor.

The blowoff valve 811 discharges some of the compressed air to the atmosphere in order to prevent surge by securing the flow rate of the impeller and prevent an increase in the compressed air supplied from the compressor 91 when the flow rate flowing through the impeller 911A or 911B is reduced. More specifically, when the flow rate flowing through the impeller is lower than a set flow rate value based on output of the pressure sensor 121, the blowoff valve 811 is opened to prevent generation of the surge.

The control unit 190 outputs the IGV opening degree command serving as a flow rate regulation command of each of the impellers to inlet guide vanes 921A and 921B and controls the inlet guide vanes 921A and 921B based on the detection result of the pressure sensor 121.

In addition, the control unit 190 compares a set point set as a lower limit target value of a flow rate with a flow rate of each impeller, and corrects a flow rate regulation command of another impeller based on the comparison result.

Accordingly, when a flow rate of a certain impeller is smaller than a set point, the compressor control device 11 can subtract a flow rate corresponding to a difference between the flow rate and the set point of the impeller from a flow rate target value of the other impeller. Accordingly, the compressor control device 11 can increase the flow rate of the impeller having a flow rate smaller than the set point to approach the set point without increasing the flow rate of all the impellers.

In particular, the compressor control device 11 can control all the flow rates while avoiding a situation in which the flow rate of the impeller having a small flow rate is further reduced to open the blowoff valve 811 when a performance difference is generated between the plurality of impellers and causes a difference between the flow rates. In this way, even when a performance difference is generated between the plurality of impellers, the compressor control device 11 can reduce a decrease in efficiency of the compressor 91.

When the flow rate for preventing the surge cannot be secured even by correction of the flow rate regulation command of the other impeller, the control unit 190 prevents the surge by opening the blowoff valve and securing the flow rate.

In addition, when a flow rate of a certain impeller is smaller than the set point, the control unit 190 may control the inlet guide vane 921A or 921B to fix the flow rate of the impeller.

Accordingly, the compressor control device 11 can prevent generation of the surge as the flow rate of the impeller is further reduced. Here, as the flow rate of the other impeller is reduced, the compressor control device 11 can prevent generation of the surge without the necessity of opening the blowoff valve 811 and discharging the compressed air to the atmosphere.

In addition, the control unit 190 may release the fixing of the flow rate of the impeller when the set point and the flow rate command value are separated from each other by a predetermined level or more.

Accordingly, the compressor control device 11 can vary the flow rate of the impeller and generate the compressed air having a desired flow rate in the compressor 91 when there is no need to increase the flow rate of the impeller and perform the surge prevention control. In particular, the compressor control device 11 can generate a larger amount of compressed air in the compressor 91 by varying the flow rates of the plurality of impellers disposed in parallel.

In addition, the control unit 190 may release the fixing of the flow rate of the impeller when a flow rate of every impeller are smaller than the set point.

Accordingly, the compressor control device 11 can reduce the flow rate of each of the impellers from the set point to a surge control line showing a reference flow rate that opens the blowoff valve 811. That is, the compressor control device 11 can delay the timing at which the blowoff valve 811 is opened by reducing a marginal flow rate formed between the surge control line and the set point, and at this point, can reduce a decrease in efficiency of the compressor 91.

Further, the compressor control device 11, which is an example of the pressure detection unit according to the embodiment, may further include a pressure sensor configured to detect a pressure of the inlet port-side flow path W11A or W11B. Then, the control unit 190 may output a flow rate regulation command based on the pressure of the inlet port-side flow path W11A or W11B.

Accordingly, the compressor control device 11 can more accurately generate the compressed air having a desired flow rate even when the pressure of the inlet port-side flow path W11A or W11B is varied, such as when there is a separate process at the upstream side.

Second Embodiment

In a second embodiment, an example which further specifies the compressor system 1 according to the first embodiment will be described.

Figure 2:
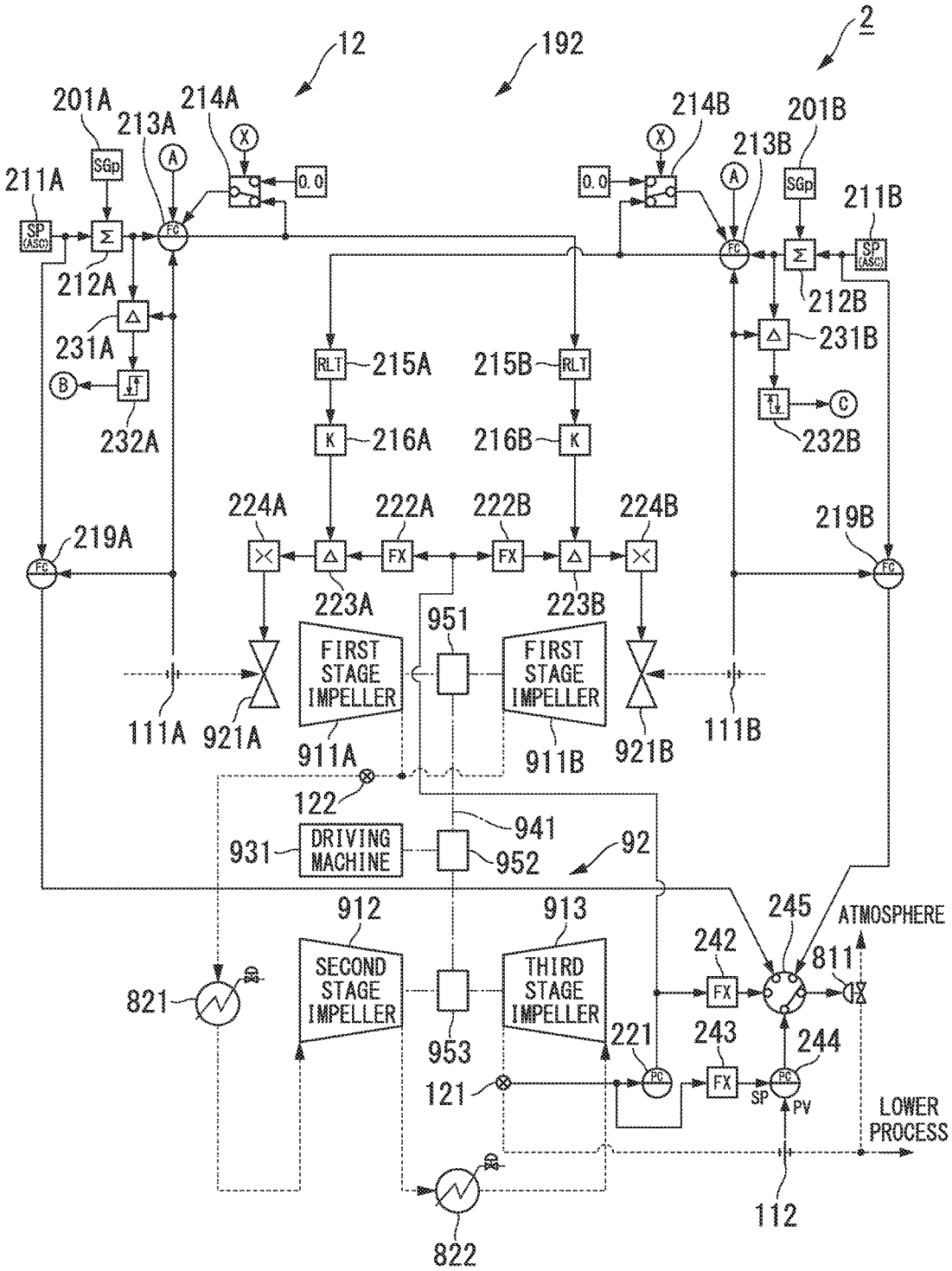
FIG. 2 is a schematic configuration view showing a configuration of a compressor system according to a second embodiment of the present invention.

FIG. 2 is a schematic configuration view showing a configuration of a compressor system according to the second embodiment of the present invention. In FIG. 2, a compressor system 2 includes a compressor control device 12, a compressor 92, a blowoff valve 811, and coolers 821 and 822.

The compressor 92 includes impellers 911A, 911B, 912 and 913, inlet guide vanes 921A and 921B, a driving machine 931, a shaft 941, and gear boxes 951, 952 and 953.

The compressor control device 12 includes flow rate sensors 111A, 111B and 112, pressure sensors 121 and 122, and a control unit 192. The control unit 192 includes set point gap storage units 201A and 201B, anti-surge control reference point setting units 211A and 211B, set point setting units 212A and 212B, flow rate control units 213A, 213B and 244, switches 214A, 214B and 245, rate limiters 215A and 215B, gain multiplication units 216A and 216B, a pressure control unit 221, function operation units 222A, 222B, 242 and 243, subtraction units 223A, 223B, 231A and 231B, magnitude determination units 224A and 224B, hysteresis units 232A and 232B, and a logical operation unit, which will be described below.

In FIG. 2, components having the same functions corresponding to the components of FIG. 1 are designated by the same reference numerals 111A, 111B, 121, 911A, 911B, 921A and 922B, and description thereof will be omitted. In addition, in FIG. 2, a shaft is shown by a chain line, a flow path of air is shown by a broken line, and a flow of data or control information is shown by a solid line.

In addition, in FIG. 2, "A," "B," "C" and "X" surrounded by circles represent input/output with respect to a logical operation unit (to be described below).

The impellers 911A, 911B, 912 and 913 are constituted by three stages, and the compressed air output from the impellers 911A and 911B of a first stage are further compressed by the impeller 912 of a second stage and the impeller 913 of a third stage.

Each of the impellers 911A, 911B, 912 and 913 is coupled to the driving machine 931 via the shaft 941. The impellers 911A and 911B of the first stage are disposed at one end of the shaft 941. In addition, the impeller 912 of the second stage and the impeller 913 of the third stage are disposed at the other end of the shaft 941. The driving machine 931 is connected to the middle of the shaft 941. Each of the impellers and the driving machine 931 are connected to a shaft 934 via the gear boxes 951, 952 and 953. Further, various instruments that generate a rotational force can be used as the driving machine 931. For example, the driving machine 931 may be a motor or an engine. In addition, the gear boxes 951, 952 and 953 may or may not be included according to disposition or characteristics of a driving machine. For example, a speed-variable driving machine and the impeller may be directed coupled using a shaft and may be configured without using the gear box.

In addition, the coolers 821 and 822 are installed between the impeller of the first stage and the impeller of the second stage and between the impeller of the second stage and the impeller of the third stage, and cool the air having a high temperature by compression.

The blowoff valve 811 is installed at an outlet port side of the compressor 92, and the blowoff valve 811 is opened to discharge some of the compressed air generated by the compressor 92 to the atmosphere.

The pressure sensor 121 detects a pressure of the outlet port side of the impeller 913 of the third stage.

An IGV opening degree command serving as a flow rate regulation command with respect to the inlet guide vane 921A is generated by the pressure control unit 221 and the function operation unit 222A based on an outlet port-side pressure of the third stage detected by the pressure sensor 121. An IGV opening degree command serving as a flow rate regulation command with respect to the inlet guide vane 921B is generated by the pressure control unit 221 and the function operation unit 222B based on an outlet port-side pressure of the third stage detected by the pressure sensor 121.

The pressure sensor 122 detects a pressure of the outlet port side of the impellers 911A and 911B of the first stage.

Both of the anti-surge control reference point setting units 211A and 211B open the blowoff valve 811 and set a reference flow rate based on the pressure of the outlet port side of the impellers 911A and 911B detected by the pressure sensor 122.

The set point setting units 212A and 212B set a set point by adding a set point gap SGp serving as a predetermined margin to the flow rates set by the anti-surge control reference point setting units 211A and 211B. The set point is used as a lower limit target value of the flow rates of the impellers 911A and 911B.

The set point gap storage units 201A and 201B store the set point gap serving as a predetermined margin added by the set point setting units 212A and 212B.

The flow rate control unit 213A generates a correction value with respect to the IGV opening degree command generated by the pressure control unit 221 and the function operation unit 222B. That is, the flow rate control unit 213A generates a correction value with respect to flow rate control of the other impeller 911B based on a state of the impeller 911A. In particular, in the following IGV limit control, the flow rate control unit 213A compares the set point set by the set point setting unit 212A with the flow rate of each of the impellers, and corrects a flow rate regulation command of the other impeller 911B based on the comparison result.

The flow rate control unit 213B generates a correction value with respect to the IGV opening command generated by the pressure control unit 221 and the function operation unit 222A. That is, the flow rate control unit 213B generates a correction value with respect to the flow rate control of the other impeller 911A based on a state of the impeller 911B. In particular, in the following IGV limit control, the flow rate control unit 213B compares the set point set by the set point setting unit 212B with the flow rate of each of the impellers, and corrects a flow rate regulation command of the other impeller 911A based on the comparison result.

The switch 214A switches the input into the flow rate control unit 213A to any one of a closed loop and 0 according to the state of the compressor system 2. The switch 214B switches the input into the flow rate control unit 213B to any one of the closed loop and 0 according to the state of the compressor system 2. Processing performed by the switch 214A and 214B will be described below.

The rate limiters 215A and 215B performs rate limit processing for suppressing a variation rate within a certain range in order to prevent abrupt variation with respect to the correction values generated by the flow rate control units 213A and 213B.

Both of the gain multiplication units 216A and 216B multiply a gain with respect to a correction value obtained through rate limit processing.

The subtraction unit 223A performs correction of subtracting a correction value from the IGV opening degree command generated by the pressure control unit 221 and the function operation unit 222A. The subtraction unit 223B performs correction of subtracting a correction value from the IGV opening degree command generated by the pressure control unit 221 and the function operation unit 222B.

The magnitude determination unit 224A determines a magnitude relation between the IGV opening degree command after the correction and the maximum/minimum opening degree of the inlet guide vane 921A, and outputs the opening command or the closing command to the inlet guide vane 921A according to the determination result. The magnitude determination unit 224B determines a magnitude relation between the IGV opening degree command after the correction and the maximum/minimum opening degree of the inlet guide vane 921B, and outputs the opening command or closing command to the inlet guide vane 921B according to the determination result.

The subtraction unit 231A subtracts the set point set by the set point setting unit 212A from the flow rate of the impeller 911A detected by flow rate sensor 111A. The subtraction unit 231B subtracts the set point set by the set point setting unit 212B from the flow rate of the impeller 911B detected by the flow rate sensor 111B.

The hysteresis unit 232A determines whether the calculation result of the subtraction unit 231A is positive or negative. Since the determination result uses mode switching in a logical operation unit (to be described below), in order to avoid frequent occurrence of the mode switching, the hysteresis unit 232A sets predetermined hysteresis when it is determined whether the calculation result of the subtraction unit 231A is positive or negative. The hysteresis unit 232B determines whether the calculation result of the subtraction unit 231B is positive or negative. Like the case of the hysteresis unit 232A, the hysteresis unit 232B sets predetermined hysteresis when it is determined whether the calculation result of the subtraction unit 231B is positive or negative.

The flow rate sensor 112 detects a flow rate of the outlet port side of the impeller 913 of the third stage.

The pressure control unit 221, the function operation unit 242 and 243, and the flow rate control unit 244 generate control information with respect to the blowoff valve 811 based on the flow rate or the pressure of the outlet port side of the impeller 913 of the third stage.

The switch 245 performs switching of the control information with respect to the blowoff valve 811, and controls opening/closing of the blowoff valve 811 by outputting the control information to the blowoff valve 811.

Here, characteristics and anti-surge control of the impeller will be described with reference to FIGS. 3 to 5.

Figure 3:
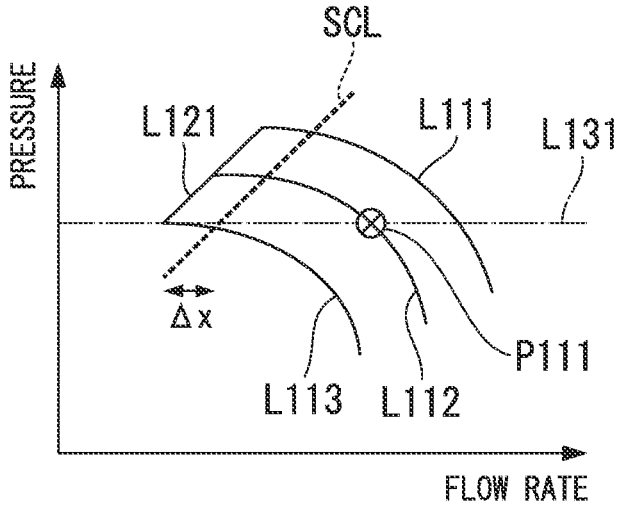
FIG. 3 is a view showing a first example of a performance curve of an impeller according to the embodiment.

FIG. 3 is a view showing a first example of a performance curve of the impeller. In FIG. 3, lines L111, L112 and L113 are pressure P-flow rate F curves in opening degrees of IGV, and in particular, the line L111 is a pressure P-flow rate F curve when the IGV is a maximum opening degree (entirely opened). In addition, a line L121 is a surge line, and surging occurs in a region of a left side thereof. More specifically, an air volume is reduced at a region of a left side of the surge line, and a ratio between an impeller inlet port-side pressure and an impeller outlet port-side pressure is increased. For this reason, surges (vibrations) occur when the impeller cannot cause wind to flow toward a wake. When the air volume is increased, the impeller causes the wind to flow toward the wake, and the surge is suppressed.

In addition, a line SCL is a surge control line showing a relation between the outlet port-side pressure of the impeller of the first stage and the flow rate control target value in the anti-surge control. As described above, the surge is generated in the region of the left side of the surge line L121. For this reason, in a region of a right side of the surge control line SCL having a margin with respect to the surge line L121, the anti-surge control for controlling the pressure or the flow rate of the compressor is performed.

The anti-surge control is performed by opening the blowoff valve and allowing some of the compressed air to escape to the atmosphere to increase the outlet port flow rate. Since some of the compressed air escapes to the atmosphere, efficiency of the compressor is decreased.

In addition, a line L131 shows the current outlet port-side pressure of the first stage, and a point P111 shows an example of the outlet port-side pressure and the inlet port-side flow rate according to the current IGV opening degree.

Figure 4:
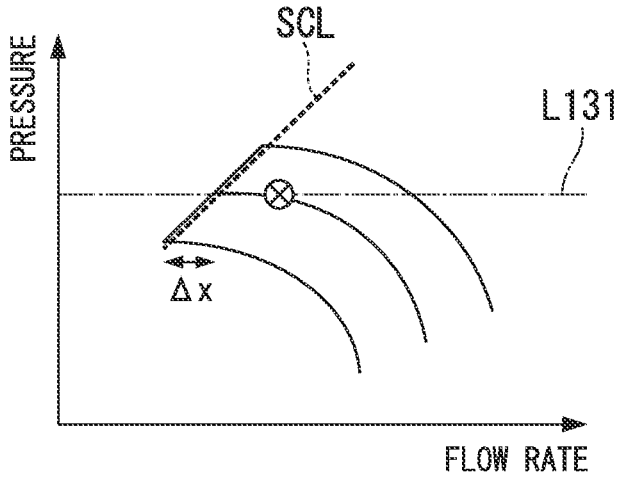
FIG. 4 is a view showing a second example of a performance curve of the impeller according to the embodiment.

FIG. 4 is a view showing a second example of a performance curve of the impeller. The impeller shown in FIG. 4 has a performance lower than that of the impeller shown in FIG. 3.

When the performance of the impeller is decreased, there is a tendency for the pressure to decrease with respect to the flow rate. For this reason, when the flow rate control target value is reduced, the flow rate is likely to arrive at the surge control line SCL. When the flow rate of the impeller arrives at the surge control line SCL and the blowoff valve 811 is opened, the compressed air may be discharged to the atmosphere and decrease efficiency of the compressor 92.

Here, the compressor control device 12 sets the IGV limit control line serving as the margin with respect to the surge control line, and performs the IGV limit control using the flow rate in the IGV limit control line as the control target value when the flow rate of the impeller is small.

Figure 5:
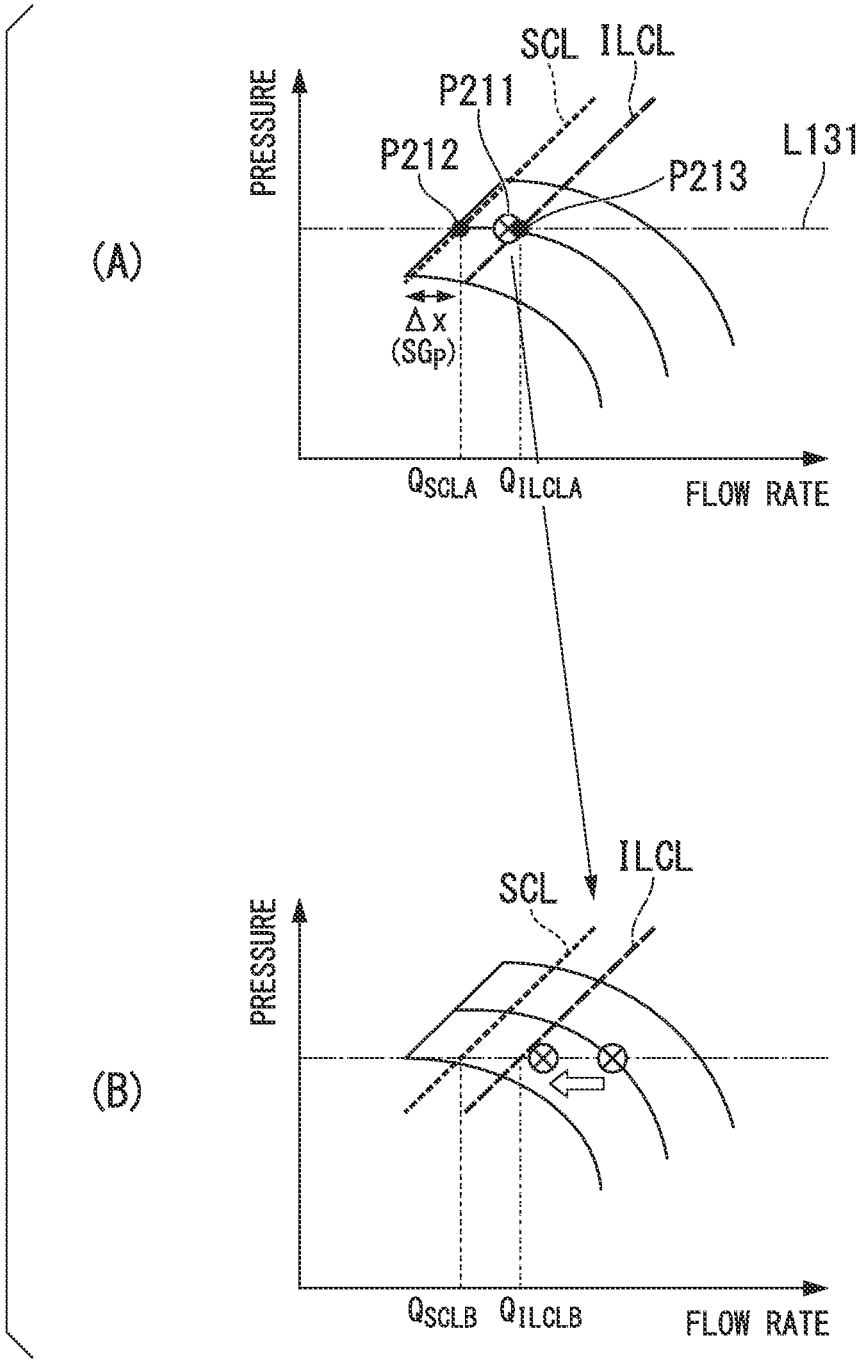
FIG. 5 is a view for describing an example of an IGV limit control line according to the embodiment.

FIG. 5 is a view for describing an example of the IGV limit control line. A performance curve shown in a part (A) of FIG. 5 is a performance curve of the impeller in which performance is decreased. Meanwhile, a performance curve shown in a part (B) of FIG. 5 is a performance curve of the impeller in which performance is not decreased. In the description of FIG. 5, the performance curve shown in FIG. 5A shows performance of the impeller 911A, and the performance curve shown in FIG. 5B shows performance of the impeller 911B.

In addition, in FIG. 5, an IGV limit control line ILCL having a margin (a set point gap SGp) corresponding to a flow rate ΔX with respect to the surge control line SCL is shown. In addition, the line L131 shows the current outlet port-side pressure of the first stage, and a point P211 shows an example of the outlet port-side pressure and the inlet port-side flow rate according to the current IGV opening degree.

Here, an intersection point P212 between the line L131 showing the outlet port-side pressure and the surge control line SCL shows a reference flow rate $Q_{SCLA}$ at which the blowoff valve 811 opens set by the anti-surge control reference point setting unit 211A. In addition, the flow rate ΔX of the margin between the surge control line SCL and the IGV limit control line ILCL corresponds to the set point gap (SGp) serving as the margin added by the set point setting unit 212A. Accordingly, an intersection point P213 between the line L131 and the IGV limit control line ILCL shows a set point (a flow rate $Q_{ILCLA}$) set by the set point setting unit 212A.

The set point (the flow rate $Q_{ILCLA}$) is used as a lower limit target value of the flow rate of the impeller 911A in the IGV limit control. The IGV limit control is control for suppressing the blowoff valve from being opened even when any one of the impellers of the first stage arrives at the surge control line and there is a margin from the surge control line in the flow rate of the other impeller of the first stage.

In an example of the part (A) of FIG. 5, an inlet port-side flow rate of the impeller 911A shown at a point P211 is disposed at a left side of the IGV limit control line ILCL showing the set point of the IGV limit control, and the inlet port-side flow rate of the impeller 911A is smaller than the set point (the flow rate $Q_{ILCLA}$). In this case, the compressor control device 12 controls the inlet port-side flow rate of the impeller 911A to approach the set point (the flow rate $Q_{ILCLA}$) in the IGV limit control.

Here, the compressor control device 12 regulates the entire flow rate of the first stage by reducing the target flow rate according to the margin of the flow rate when there is a need to reduce the flow rate. In the example of FIG. 5, as shown in the part (B) of FIG. 5, the compressor control device 12 reduces the flow rate of the impeller 911B having the margin of the flow rate.

Next, processing performed by the compressor control device 12 in the IGV limit control will be described with reference to FIG. 6.

Figure 6:
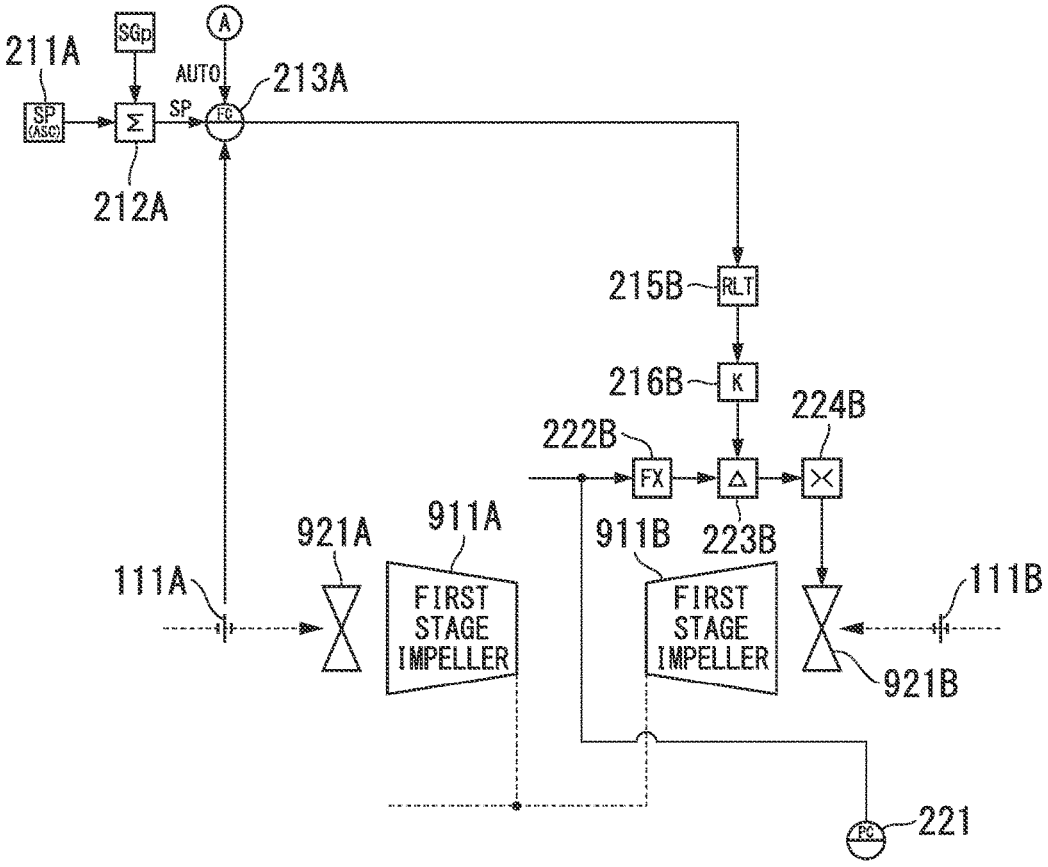
FIG. 6 is a view for describing some components of the compressor system shown in FIG. 2 according to the embodiment.

FIG. 6 is a view for describing some components of the compressor system 2 shown in FIG. 2. In FIG. 6, among the components shown in FIG. 2, the impellers 911A and 911B, the inlet guide vanes 921A and 921B, the flow rate sensors 111A and 111B, the anti-surge control reference point setting unit 211A, the set point setting unit 212A, the flow rate control unit 213A, the rate limiter 215B, the gain multiplication unit 216B, the pressure control unit 221, the function operation unit 222B, the subtraction unit 223B and the magnitude determination unit 224B are shown.

For example, when the flow rate of the impeller 911A is smaller than the set point (the flow rate $Q_{ILCLA}$ in the example of FIG. 5) of the IGV limit control, the compressor control device 12 performs the IGV limit control and causes the flow rate of the impeller 911A to approach the set point.

Specifically, the flow rate control unit 213A calculates a target flow rate in proportional integral control (PI control) in order to match the flow rate of the impeller 911A detected by the flow rate sensor 111A with the set point of the IGV limit control set by the set point setting unit 212A.

Further, in the following description, the set point of the IGV limit control is simply referred to as "a set point."

Then, the subtraction unit 223B subtracts the flow rate obtained through fairing such as rate limit processing, gain multiplication, or the like, with respect to the target flow rate calculated by the flow rate control unit 213A from the target flow rate of the impeller 911B. That is, the compressor control device 12 applies offset to the impeller 911B to reduce only an incremental difference of the flow rate in the impeller 911A from an original target flow rate.

As the impeller 911B reduces the flow rate, the flow rate command value output from the pressure control unit 221 is increased, and as a result, the flow rate of the impeller 911A approaches the set point.

Meanwhile, when the flow rate is larger than the set point at both of the impellers 911A and 911B, the compressor control device 12 does not perform the IGV limit control, and the flow rate control unit 213A or 213B performs tracking while constantly holding the correction value. This will be described with reference to FIG. 7.

Figure 7:
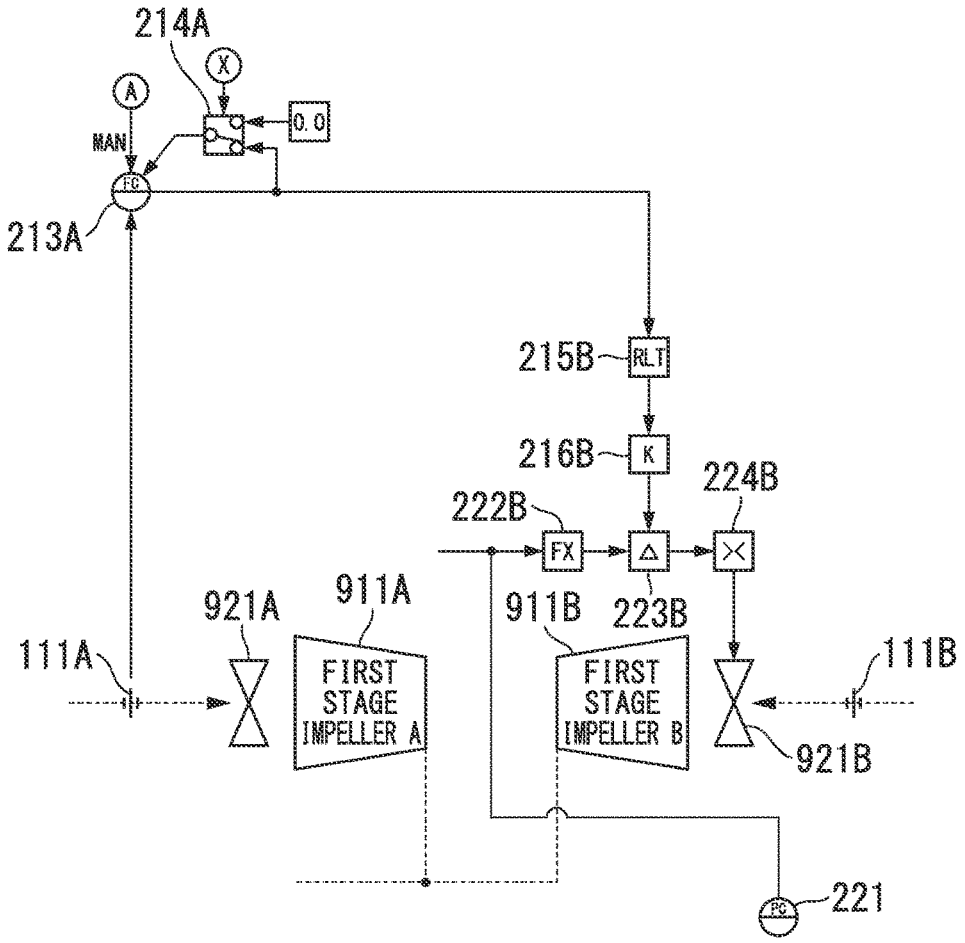
FIG. 7 is a view for describing some components of the compressor system shown in FIG. 2 according to the embodiment.

FIG. 7 is a view for describing some components of the compressor system 2 shown in FIG. 2. In FIG. 7, among the components shown in FIG. 2, the impellers 911A and 911B, the inlet guide vanes 921A and 921B, the flow rate sensors 111A and 111B, the flow rate control unit 213A, the switch 214A, the rate limiter 215B, the gain multiplication unit 216B, the pressure control unit 221, the function operation unit 222B, the subtraction unit 223B and the magnitude determination unit 224B are shown.

When the flow rate is larger than the set point at both of the impellers 911A and 911B, the flow rate control unit 213A or 213B is set to a manual mode, which is a mode in which the IGV limit control is not performed. In this case, the flow rate control unit 213A or 213B tracks a correction value set immediately before switching to a manual mode from an auto mode. In the case of FIG. 7, the flow rate control unit 213A receives the correction value directly output from the flow rate control unit 213A and outputs the correction value again in a closed loop constituted by the switch 214A.

In this way, as the flow rate control unit 213A or 213B tracks the correction value set immediately before switching to the manual mode from the auto mode, the compressor control device 12 performs correction of the target flow rate according to a performance difference between the impellers 911A and 911B. Specifically, the compressor control device 12 performs correction to reduce the flow rate of the impeller as the performance is improved. Accordingly, because the margin between the flow rate of the impeller and the surge control line is increased as the performance is deteriorated, a breadth in which the compressor 92 is controlled by the compressor control device 12 is increased without opening the blowoff valve.

Further, in a state in which an environment for performing the IGV limit control is not prepared, for example, when the driving machine 931 is stopped, the anti-surge control becomes manual, or the like, the flow rate control unit 213A or 213B sets the tracking value to zero.

In the configuration shown in FIG. 7, the switch 214A connects a constant value "0.0" and the flow rate control unit 213A, and the flow rate control unit 213A outputs the constant value.

Figure 8:
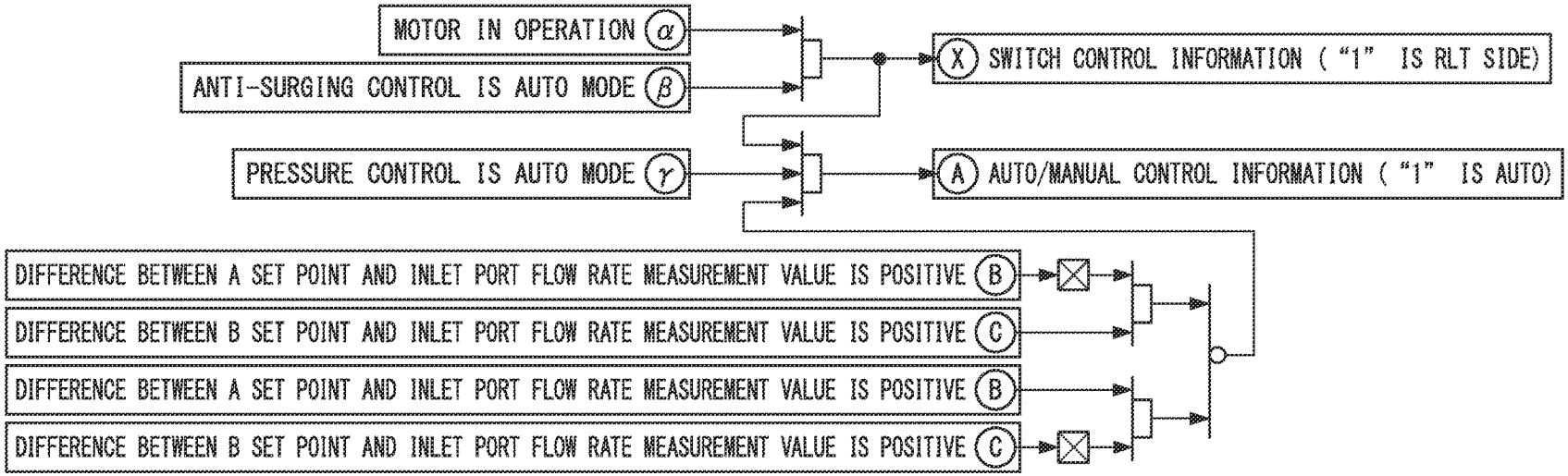
FIG. 8 is a view for describing an example of a logical operation in a logical operation unit included in a compressor control device according to the embodiment.

FIG. 8 is a view for describing an example of a logical operation of the logical operation unit included in the compressor control device 12. The logical operation unit calculates control information with respect to the switch 214A or 214B, or control information with respect to a mode in the flow rate control unit 213A or 213B.

In the logical operation shown in FIG. 8, the logical operation unit outputs control information of instructing connection to the closed loop side with respect to the switch 214A or 214B when the driving machine 931 is in operation or the anti-surging control is in the auto mode. On the other hand, when the driving machine 931 is stopped or the anti-surging control is in the manual mode, the logical operation unit outputs control information of instructing connection to a constant zero side with respect to the switch 214A or 214B.

In addition, the logical operation unit receives a logical product of three conditions under a condition in which a mode of the flow rate control unit 213A or 213B is set to auto. First, like the control of the switch 214A or 214B, the driving machine 931 is in operation, and the anti-surging control becomes the auto mode. Second, the pressure control is the auto mode, i.e., the pressure control unit 221 controls the flow rate of the impeller 911A or 911B through the pressure control. Third, in one of the impellers 911A and 911B, a difference between the set point and the inlet port flow rate measurement value is negative, and in the other impeller, a difference between the set point and the inlet port flow rate measurement value is positive. That is, one of the impellers 911A and 911B is in a state in which the IGV limit control is to be performed, and the other impeller is in a state in which there is a margin from the set point.

As described above, the control unit 192 (in particular, the pressure control unit 221) outputs the IGV opening degree command serving as the flow rate regulation command of each impeller to the inlet guide vanes 921A and 921B and controls them based on the detection result of the pressure sensor 121.

In addition, the control unit 192 (in particular, the flow rate control unit 213A and 213B) compares the set point set as the lower limit target value of the flow rate with the flow rate of each impeller, and corrects the flow rate regulation command of the other impeller based on the comparison result.

Accordingly, when the flow rate of the certain impeller is smaller than the set point, the compressor control device 12 can subtract the flow rate corresponding to the difference between the flow rate and the set point of the impeller from the flow rate target value of the other impeller. Accordingly, the compressor control device 12 can increase the flow rate of the impeller having a smaller flow rate than the set point to approach the set point without increasing the entire flow rate of the impeller.

In particular, the compressor control device 12 can control the entire flow rate while avoiding the situation in which the flow rate of the impeller having a small flow rate is further reduced to open the blowoff valve, when the performance difference is generated between the plurality of impellers and generates a difference in flow rate. In this way, the compressor control device 11 can reduce a decrease in efficiency of the compressor 92 even when the performance difference is generated between the plurality of impellers.

Third Embodiment

In the second embodiment, another example which further specifies the compressor system 1 according to the first embodiment will be described.

Figure 9:
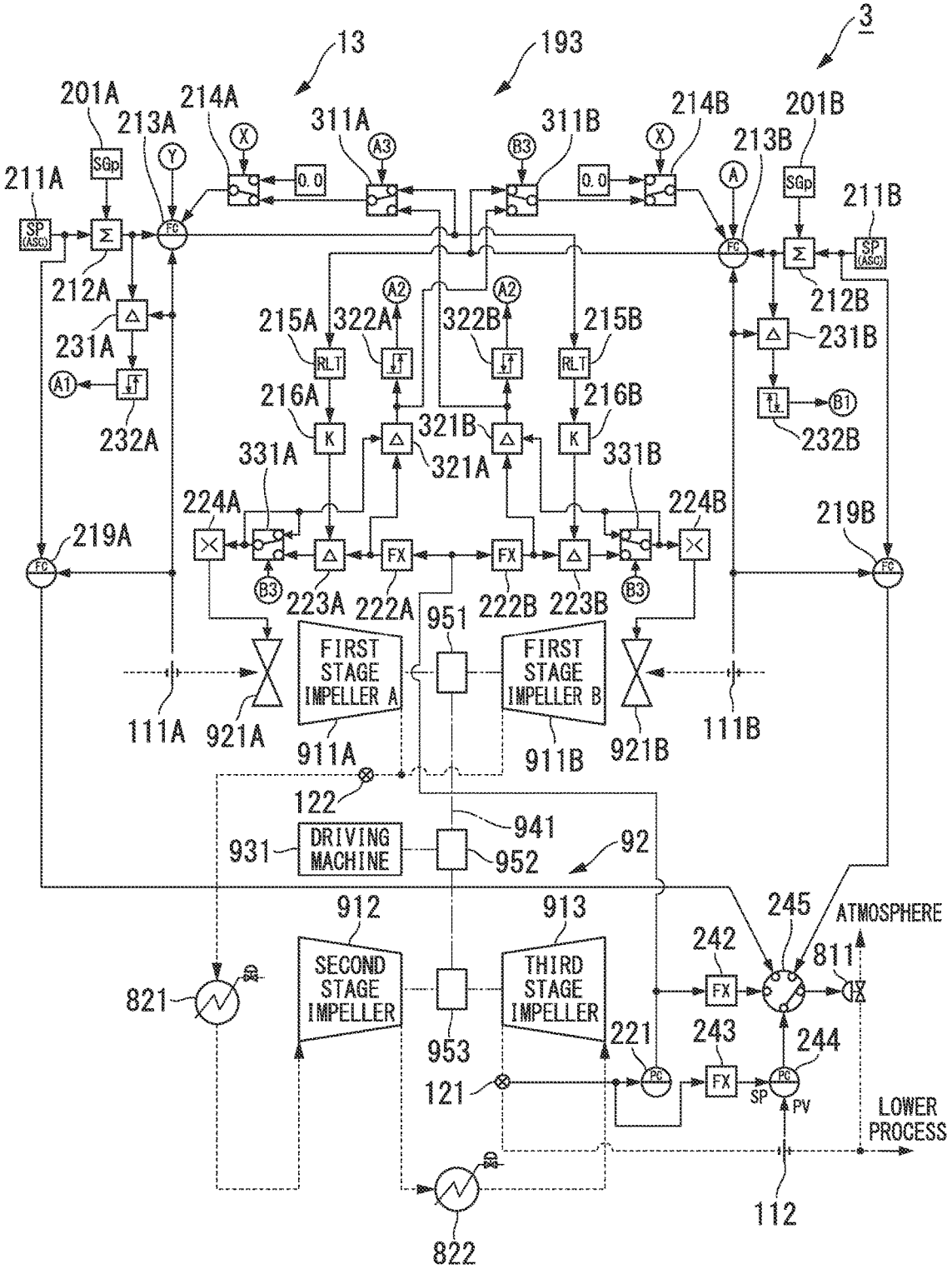
FIG. 9 is a schematic configuration view showing a configuration of a compressor system according to a third embodiment of the present invention according to the embodiment.

FIG. 9 is a schematic configuration view showing a configuration of a compressor system according to a third embodiment of the present invention. In FIG. 9, a compressor system 3 includes a compressor control device 13, a compressor 92, a blowoff valve 811, and coolers 821 and 822.

The compressor 92 includes impellers 911A, 911B, 912 and 913, inlet guide vanes 921A and 921B, a driving machine 931, a shaft 941, and gear boxes 951, 952 and 953.

The compressor control device 13 includes flow rate sensors 111A, 111B and 112, pressure sensors 121 and 122, and a control unit 193. The control unit 193 includes anti-surge control reference point setting units 211A and 211B, set point setting units 212A and 212B, flow rate control units 213A, 213B and 244, switches 214A, 214B, 245, 311A, 311B, 331A and 331B, rate limiters 215A and 215B, gain multiplication units 216A and 216B, a pressure control unit 221, function operation units 222A, 222B, 242 and 243, subtraction units 223A, 223B, 231A, 231B, 321A and 321B, magnitude determination units 224A and 224B, hysteresis units 232A, 232B, 322A and 322B, and a logical operation unit, which will be described below.

In FIG. 9, portions having the same functions corresponding to the components of FIG. 2 are designated by the same reference numerals 111A, 111B, 112, 121, 122, 201A, 201B, 211A, 211B, 212A, 212B, 213A, 213B, 244, 214A, 214B, 245, 215A, 215B, 216A, 216B, 219A, 219B, 221, 222A, 222B, 242, 243, 223A, 223B, 231A, 231B, 224A, 224B, 232A, 232B, 811, 821, 822, 92, 911A, 911B, 912, 913, 921A, 922B, 931, 941, and 951 to 953, and description thereof will be omitted. In addition, in FIG. 9, a shaft is shown by a chain line, a flow path of air is shown by broken lines, and a flow of data or control information is shown by solid lines.

In addition, "A1," "A2," "A3," "B1," "B2," "B3," "X" and "Y" in circles in FIG. 9 show input/output with respect to the logical operation unit, which will be described below.

When the set point and the flow rate of the impeller are compared, cases in which (1) the flow rate of the impeller is large at both of the impellers 911A and 911B, (2) the flow rate of one of the impellers 911A and 911B is smaller than the set point, and (3) the flow rate of the impeller is smaller than the set point at both of the impellers 911A and 911B, are considered. The compressor control device 13 performs control of the compressor 92 at an operation mode corresponding each of the three cases.

In order to perform these operation modes, the subtraction units 321A and 321B and hysteresis units 322A and 322B generate a signal showing whether divergence between the IGV opening degree and the command value is large or not at each of the inlet guide vanes 921A and 921B as the input into the logical operation unit.

The switches 331A and 331B switch fixing/non-fixing of the IGV opening degree.

(1) When the flow rate of the impeller is large at both of the impellers 911A and 911B, the flow rate control units 213A and 213B are set to the auto mode. When the compressor flow rate is sufficiently larger than the IGV limit control line, the correction value by the IGV limit control becomes zero.

Meanwhile, when the flow rate of the impeller is reduced to approach the IGV limit control line, the flow rate control unit 213A or 213B performs the PI control serving as the IGV limit control, and outputs the correction signal with respect to the flow rate command value of the opposite impeller.

Figure 10:
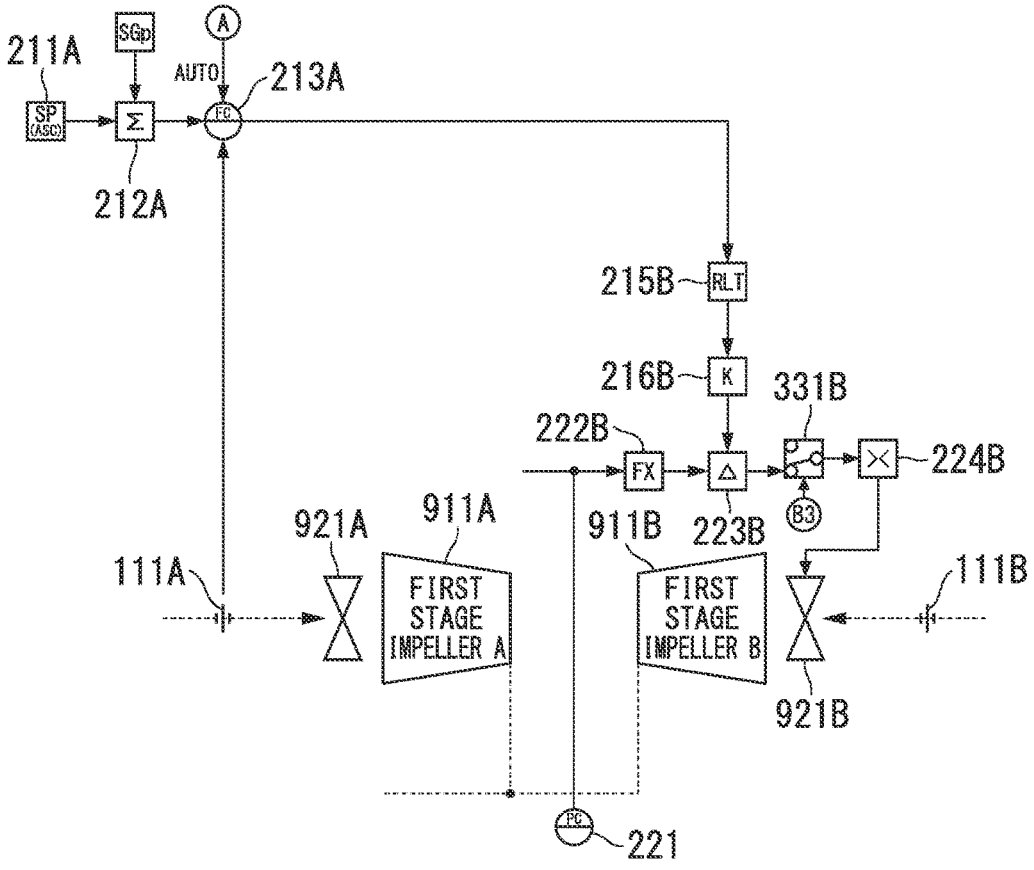
FIG. 10 is a view for describing some components of the compressor system shown in FIG. 9 according to the embodiment.

FIG. 10 is a view for describing some of the components of the compressor system 3 shown in FIG. 9. In FIG. 10, among the components shown in FIG. 9, the impellers 911A and 911B, the inlet guide vanes 921A and 921B, the flow rate sensors 111A and 111B, the anti-surge control reference point setting unit 21 IA, the set point setting unit 212A, the flow rate control unit 213A, the rate limiter 215B, the gain multiplication unit 216B, the pressure control unit 221, the function operation unit 222B, the subtraction unit 223B, the switch 331B and the magnitude determination unit 224B are shown.

According to the above-mentioned configuration, like the case of FIG. 6, the flow rate control unit 213A performs the IGV limit control.

(2) When the flow rate of any one of the impellers 911A and 911B is smaller than the set point, the compressor control device 13 fixes the IGV opening degree of the inlet guide vane of the impeller side having the flow rate smaller than the set point.

Figure 11:
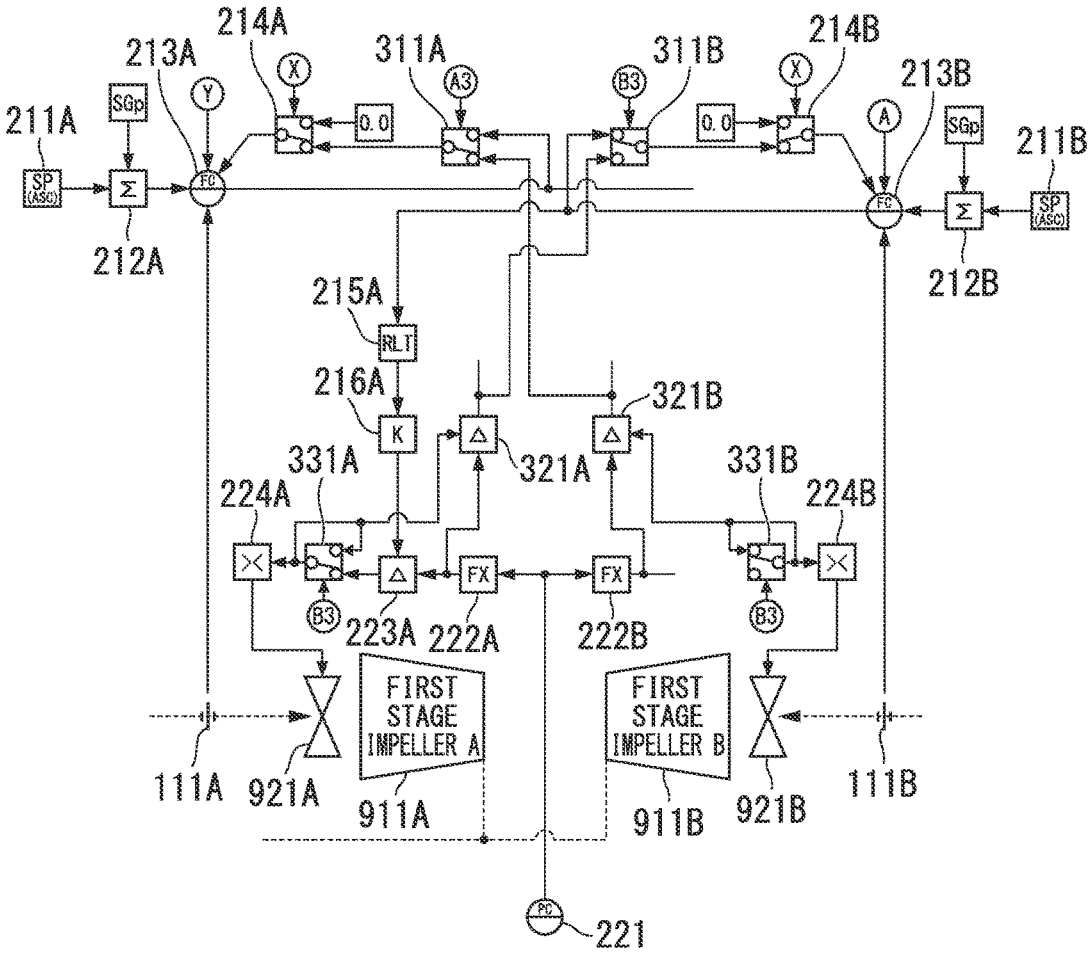
FIG. 11 is a view for describing some of the components of the compressor system shown in FIG. 9 according to the embodiment.

FIG. 11 is a view for describing some of the components of the compressor system 3 shown in FIG. 9. In FIG. 11, among the components shown in FIG. 9, the impellers 911A and 911B, the inlet guide vanes 921A and 921B, the flow rate sensors 111A and 111B, the anti-surge control reference point setting units 211A and 211B, the set point setting units 212A and 212B, the flow rate control units 213A and 213B, the switches 214A, 214B, 311A, 311B, 331A and 331B, the rate limiter 215A, the gain multiplication unit 216A, the pressure control unit 221, the function operation units 222A and 222B, the subtraction unit 223A and the magnitude determination units 224A and 224B are shown.

For example, when the flow rate of the impeller 911B is smaller than the set point, the switch 331B configures a loop to hold the IGV opening degree command value of the inlet guide vane 921B. In addition, the switches 214B and 311B configure a loop to hold the correction value in the IGV opening degree command value.

In this way, as the compressor control device 13 fixes the flow rate of the impeller, the flow rate of the impeller can be further reduced to prevent generation of the surge. Here, as the flow rate of the other impeller is reduced, the compressor control device 13 can open the blowoff valve to prevent generation of the surge without necessity of discharging the compressed air to the atmosphere.

Further, when the IGV opening degree is fixed, the compressor control device 13 performs tracking of the correction value such that the IGV opening degree is not abruptly varied when the fixing of the IGV opening degree is released.

Figure 12:
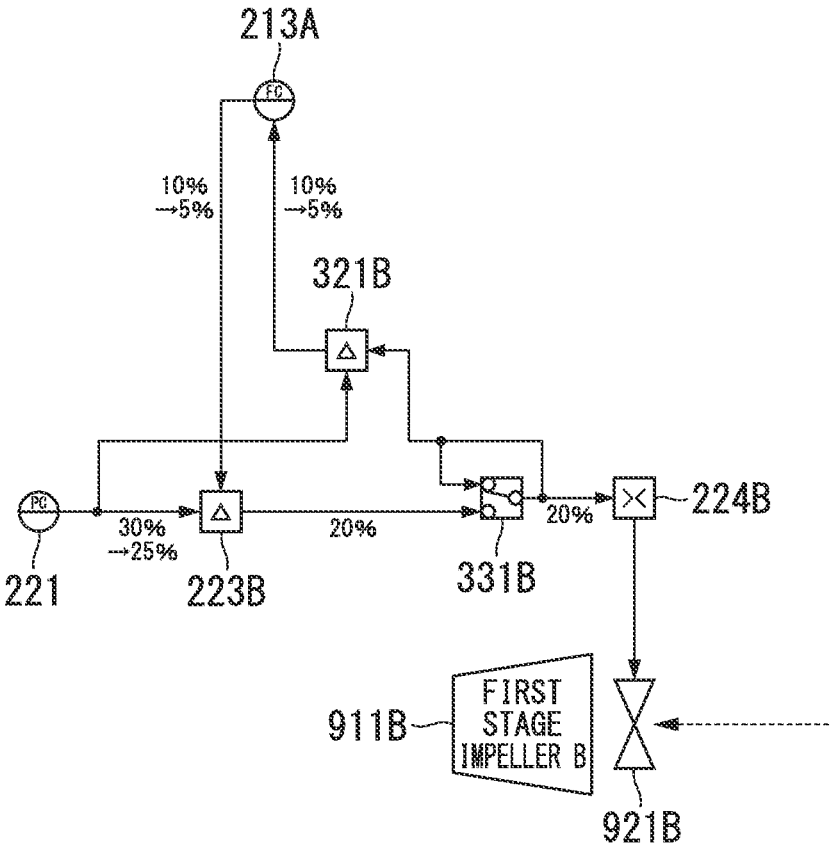
FIG. 12 is a view for describing an example of correction value tracking performed by a compressor control device according to the embodiment.

FIG. 12 is a view for describing an example of correction value tracking performed by the compressor control device 13.

In FIG. 12, among the components shown in FIG. 9, the flow rate control unit 213A, the pressure control unit 221, the subtraction units 223B and 321B, the switch 331B, the impeller 911B and the inlet guide vane 921B are shown. Further, description of some of the components on a path of a signal will also be omitted in order to simplify the drawings.

In the example shown in FIG. 12, when the IGV opening degree of the inlet guide vane 921B is fixed, the IGV opening degree command from the pressure control unit 221 is 30%, and the correction value generated by the flow rate control unit 213A is 10%. Here, in a state in which the subtraction unit 223B calculates the IGV opening degree command after correction as 20% and outputs the command to the magnitude determination unit 224B, the switch 331B configures the closed loop and the IGV opening degree of 20% is held.

After that, in the case in which the IGV opening degree command value from the pressure control unit 221 is reduced to 25%, provisionally, when the flow rate control unit 213A continues to output the correction value of 10%, the IGV opening degree command after correction becomes 15%, and the fixed value of the IGV opening degree is varied. Like this, when the switch 331B varies connection to the subtraction unit 223B side to release the fixing of the IGV opening degree, the IGV opening degree may abruptly vary from 20% to 15%.

Here, the subtraction unit 321B calculates a difference between the opening degree command from the pressure control unit 221 and the fixed value of the IGV opening degree, and varies the correction value output from the flow rate control unit 213A.

In the example of FIG. 12, when the IGV opening degree command from the pressure control unit 221 is varied to 25%, the subtraction unit 321B subtracts the IGV opening degree having the fixed value of 20% from the IGV opening degree command of 25% to calculate 5%. Then, the flow rate control unit 213A outputs 5% calculated by the subtraction unit 321B as the correction value.

Accordingly, the fixed value of the IGV opening degree and the IGV opening degree command after correction become the same value, and abrupt variation of the IGV opening degree is not generated when the switch 331B releases the fixing of the IGV opening degree.

(3) When the flow rate of the impeller is smaller than the set point at both of the impellers 911A and 911B, the compressor control device 13 can release the fixing of the IGV opening degree, and both of the impellers 911A and 911B can also vary the flow rate. Here, the compressor control device 13 tracks the correction value immediately before switching to the state (3).

Figure 13:
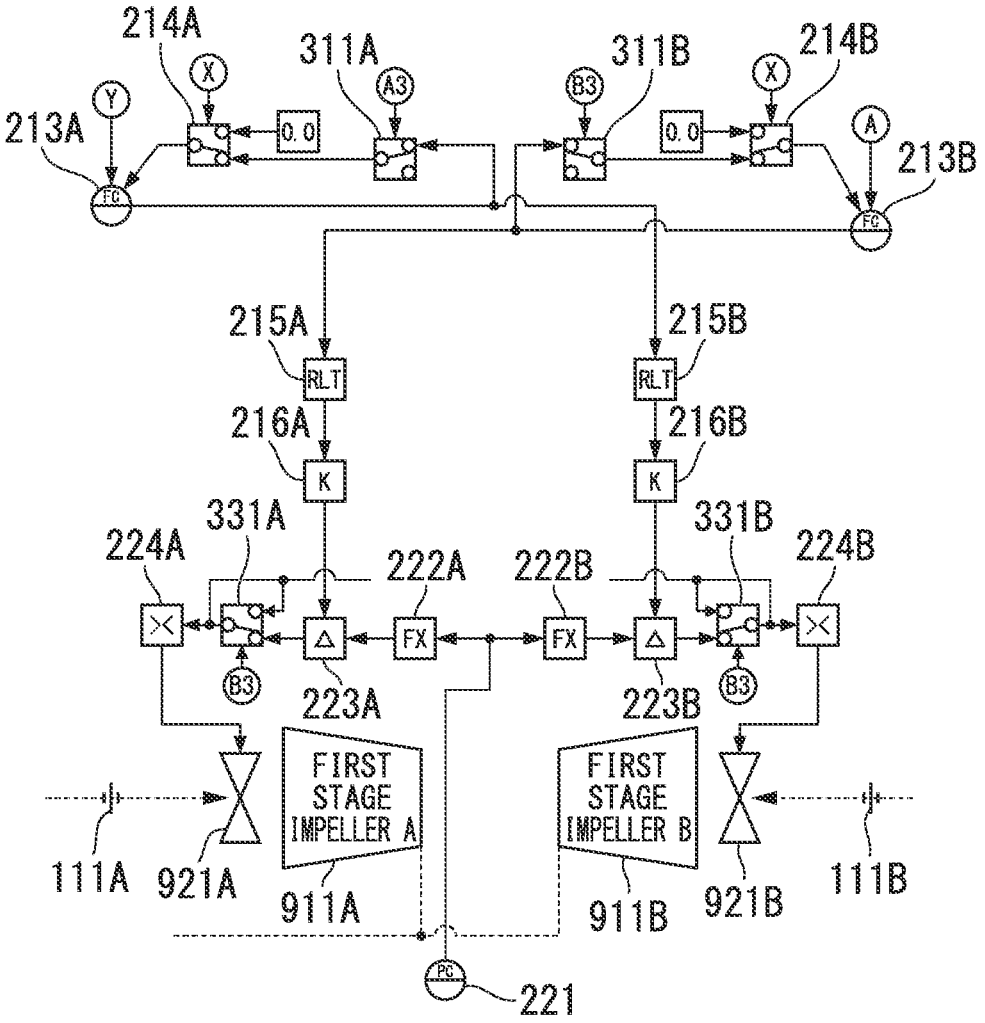
FIG. 13 is a view for describing some of the components of the compressor system shown in FIG. 9 according to the embodiment.

FIG. 13 is a view for describing some of the components of the compressor system 3 shown in FIG. 9. In FIG. 11, among the components shown in FIG. 9, the impellers 911A and 911B, the inlet guide vanes 921A and 921B, the flow rate sensors 111A and 111B, the flow rate control units 213A and 213B, the switches 214A, 214B, 311A, 311B, 331A and 331B, the rate limiters 215A and 215B, the gain multiplication units 216A and 216B, the pressure control unit 221, the function operation units 222A and 222B, the subtraction units 223A and 223B, and the magnitude determination units 224A and 224B are shown.

In FIG. 13, the switches 214A and 311A configure the closed loop, and the flow rate control unit 213A holds the correction value at the closed loop. The switches 214B and 311B and the flow rate control unit 213B are also the same as above.

Then, the subtraction unit 223A subtracts the correction value from the flow rate command from the pressure control unit 221, and outputs the flow rate command after correction to the inlet guide vane 921A. The impeller 911B is also the same as above.

In this way, when the flow rates of both of the impellers 911A and 911B is smaller than the set point, the switches 331A and 331B release the fixing of the flow rate of the impeller.

Accordingly, the compressor control device 13 can reduce the flow rate of each of the impellers from the set point to the surge control line showing the reference flow rate of opening the blowoff valve 811. That is, the compressor control device 13 can delay the timing of opening the blowoff valve 811 and thus can reduce a decrease in efficiency of the compressor 92 by reducing the flow rate according to the margin formed between the surge control line and the set point.

In addition, the compressor control device 13 performs correction of the target flow rate according to the performance difference between the impellers 911A and 911B by tracking the correction value immediately before switching to the mode of (3). Specifically, the compressor control device 13 performs the correction such that the flow rate of the impeller is reduced as the performance is increased. Accordingly, because a margin between the flow rate of the impeller at which the performance is deteriorated and the surge control line is increased, a width in which the compressor control device 13 controls the compressor 92 is increased without opening the blowoff valve.

Figure 14:
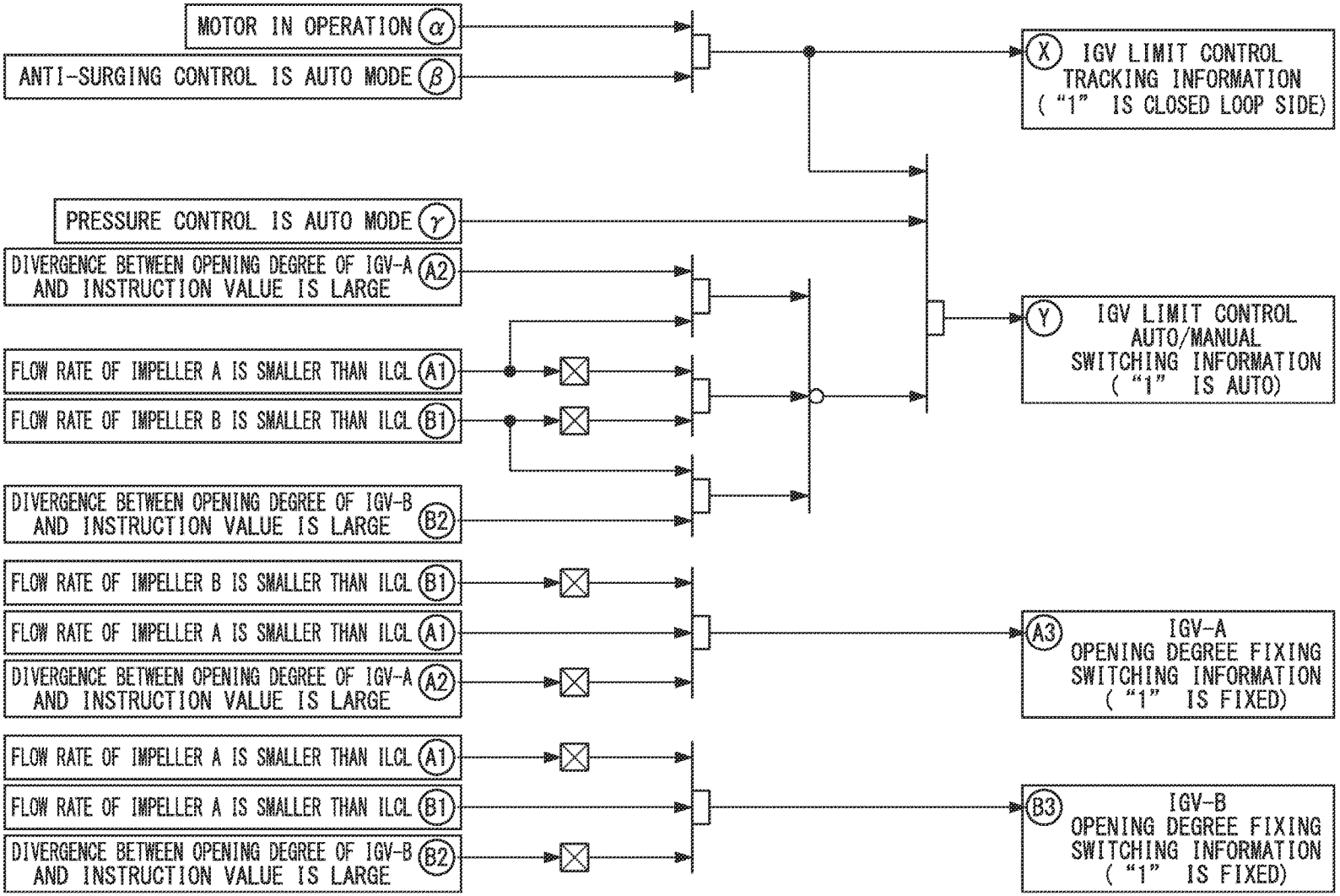
FIG. 14 is a view for describing an example of a logical operation in a logical operation unit included in a compressor control device according to the embodiment.

FIG. 14 is a view for describing an example of a logical operation in the logical operation unit included in the compressor control device 13. The logical operation unit calculates the control information with respect to the switch 214A, 214B, 311A or 311B, and the control information with respect to a mode in the flow rate control unit 213A or 213B.

In the logical operation shown in FIG. 14, the logical operation unit performs the IGV limit control when the driving machine 931 is in operation and the anti-surging control is in the auto mode. In addition, the case in which the logical operation unit automatically sets the IGV limit control is the case of the above-mentioned (1). Specifically, the logical operation unit obtains a logical product of three conditions under a condition in which the IGV limit control is automatically set.

First, the driving machine 931 is in operation and the anti-surging control is in the auto mode. Second, the pressure control is the auto mode, i.e., the pressure control unit 221 controls the flow rate of the impeller 911A or 911B through the pressure control. Third, divergence between the IGV opening degree and the opening degree command value of the inlet guide vane 921A is increased and the flow rate of the impeller 911A is smaller than the IGV limit control line, or the flow rates of both of the impellers 911A and 911B are increased to be larger than the IGV limit control line, or divergence between the IGV opening degree and the opening degree command value of the inlet guide vane 921B is increased and the flow rate of the impeller 911B is smaller than the IGV limit control line.

Further, the condition in which the divergence between the IGV opening degree and opening degree command value of the inlet guide vane 921A is increased and the flow rate of the impeller 911A is smaller than the IGV limit control line is a condition for transition from (2) to (1). The condition in which the divergence between the IGV opening degree and the opening degree command value of the inlet guide vane 921B is increased and the flow rate of the impeller 911B is smaller than the IGV limit control line is also the same as above.

In addition, the condition under which the logical operation unit fixes the IGV opening degree of the inlet guide vane 921A is that the flow rate of the impeller 911B be larger than the IGV limit control line, the flow rate of the impeller 911A be smaller than the IGV limit control line, and the divergence between the IGV opening degree and the opening degree command value of the inlet guide vane 921A not be increased.

In addition, the condition under which the logical operation unit fixes the IGV opening degree of the inlet guide vane 921B is that the flow rate of the impeller 911A be increased to be larger than the IGV limit control line, the flow rate of the impeller 911B be smaller than the IGV limit control line, and the divergence between the IGV opening degree and the opening degree command value of the inlet guide vane 921B not be increased.

That is, the logical operation unit fixes the IGV opening degree of the inlet guide vane applied to the impeller when the flow rate of any one of the impellers 911A and 911B is smaller than the IGV limit control line and the divergence between the flow rate and the flow rate command value of the impeller having the flow rate smaller than the IGV limit control line is larger than a predetermined value.

As described above, the control unit 193 controls a corresponding one of the inlet guide vanes 921A and 921B to fix the flow rate of the impeller when the flow rate of the impeller 911A or 911B is smaller than the set point.

Accordingly, the compressor control device 13 can prevent the flow rate of the impeller from being further reduced and the surge from being generated. Here, as the flow rate of the other impeller is reduced, the compressor control device 13 can prevent generation of the surge without necessity of opening the blowoff valve 811 and discharging the compressed air to the atmosphere.

In addition, the control unit 193 releases the fixing of the flow rate of the impeller when there is a predetermined interval or more between the set point and the flow rate command value.

Accordingly, the compressor control device 13 can vary the flow rate of the impeller to generate the compressed air having a desired flow rate in the compressor 92 when there is no necessity to increase the flow rate of the impeller and perform the surge prevention control. In particular, the compressor control device 13 can generate a larger amount of compressed air in the compressor 92 by varying the flow rate of the plurality of impellers disposed in parallel.

In addition, the control unit 193 releases the fixing of the flow rate of the impeller when the flow rates of both of the impellers are smaller than the set point.

Accordingly, the compressor control device 13 can reduce the flow rate of each of the impellers from the set point to the surge control line that opens the blowoff valve and shows the reference flow rate. That is, the compressor control device 13 can delay the timing of opening the blowoff valve and thus reducing a decrease in efficiency of the compressor 92 by reducing the flow rate according to the margin formed between the surge control line and the set point.

In this way, the compressor control device 13 can perform finer processing than the compressor control device 12. Meanwhile, the compressor control device 12 is more simply controlled than the compressor control device 13, and thus maintenance or alteration may be easily performed.

Further, the compressor control device 13 may further include a pressure sensor configured to detect a pressure in the inlet port-side flow path, as an example of the pressure detection unit according to the embodiment. Then, the control unit 193 may be configured to output a flow rate regulation command based on the pressure of the inlet port-side flow path.

Accordingly, the compressor control device 13 can more precisely generate the compressed air having a desired flow rate even when the pressure in the inlet port-side flow path is varied, such as when there is a separate process at the upstream side.

Further, processing of each part may be performed by recording a program for realizing functions of all or some of the compressor control devices 11, 12 and 13 on a computer-readable recording medium, reading the program recorded on the recording medium using a computer system, and performing the program. Further, the "computer system" described above includes an OS or hardware such as peripheral devices, or the like.

In addition, the "computer system" also includes a homepage providing environment (or a display environment) when a WWW system is used.

In addition, the "computer-readable recording medium" is referred to as a portable medium such as a flexible disk, a magneto-optical disc, a ROM, a CD-ROM, or the like, and a storage device such as a hard disk or the like installed in the computer system. Further, the "computer-readable recording medium" also includes an object that holds a program for a certain time such as an object for dynamically holding a program for a short time like a communication wire when the program is transmitted via a network such as the Internet or the like or a communication line such as a telephone line or the like, and like a volatile memory in the computer system which serves as a server or a client in this case. In addition, the program may be configured to realize some of the above-mentioned functions, and further, the above-mentioned functions may be realized in combination with the program recorded in the computer system.

As described above, while the embodiments of the present invention have been described in detail with reference to the accompanying drawings, a specific configuration is not limited to the embodiments and design changes that do not depart from the spirit of the present invention are also included in the present invention.

INDUSTRIAL APPLICABILITY

The present invention relates to a compressor control device configured to control a flow rate of a compressor having a plurality of impellers connected to an outlet port-side flow path in parallel and a flow rate regulation unit configured to regulate a flow rate of each of the impellers, the compressor control device including: a pressure detection unit configured to detect a pressure of the outlet port-side flow path; a flow rate detection unit configured to detect the flow rate of each of the impellers; and a control unit configured to output a flow rate regulation command of each of the impellers to the flow rate regulation unit and control the flow rate regulation unit based on the detection result of the pressure detection unit, wherein the control unit compares a set point set as a lower limit target value of the flow rate with the flow rate of each of the impellers, and corrects a flow rate regulation command of the other impeller based on the comparison result.

According to the present invention, a decrease in efficiency can be reduced even when a performance difference is generated between the plurality of impellers.

REFERENCE SIGNS LIST

11 compressor control device
91 compressor
111A, 111B flow rate sensor
121 pressure sensor
190 control unit
811 blowoff valve
911A, 911B impeller
921A, 921B inlet guide vane

The invention claimed is:

1. A compressor control device configured to control a flow rate of a compressor having a plurality of impellers connected to an outlet port-side flow path in parallel and a flow rate regulation unit configured to regulate a flow rate of each of the impellers, the compressor control device comprising:

a pressure detection unit configured to detect a pressure of the outlet port-side flow path;

a flow rate detection unit configured to detect the flow rate of each of the impellers; and a control unit configured to output a flow rate regulation command of each of the impellers to the flow rate regulation unit and control the flow rate regulation unit based on the detection result of the pressure detection unit, wherein the control unit compares a set point set as a lower limit target value of a flow rate with the flow rate of each of the impellers, and corrects the flow rate regulation command of another impeller of the plurality of impellers based on a comparison result of a certain impeller of the plurality of impellers, and wherein when a flow rate of the certain impeller is smaller than the set point, the control unit controls the flow rate regulation unit to reduce the flow rate of the another impeller and fix the flow rate of the certain impeller to a set value by fixing the flow rate regulation command of the certain impeller and regulating the flow rate regulation command of the another impeller.

2. The compressor control device according to claim 1, wherein the control unit releases a fixing status of the flow rate of the certain impeller when the set point and a flow rate command value corresponding to the flow rate regulation command are spaced a predetermined extent or more from each other.

3. The compressor control device according to claim 1, wherein the control unit releases a fixing status of the flow rate of the certain impeller when the flow rates of both of the impellers are smaller than the set point.

4. The compressor control device according to claim 1, wherein the pressure detection unit detects a pressure of an inlet port-side flow path, and the control unit outputs the flow rate regulation command based on the pressure of the inlet port-side flow path.

5. A compressor system comprising the compressor control device according to claim 1.

6. A compressor control method of a compressor control device configured to control a flow rate of a compressor having a plurality of impellers connected to an outlet port-side flow path in parallel, the compressor control method comprising:

a pressure detection step of detecting a pressure of the outlet port-side flow path;

a flow rate detection step of detecting a flow rate of each of the impellers;

a flow rate regulation step of regulating the flow rate of each of the impellers; and a control step of outputting a flow rate regulation command of each of the impellers in the flow rate regulation step to control the flow rate regulation step based on the detection result in the pressure detection step, wherein, in the control step, a set point set as a lower limit target value of a flow rate and the flow rate of each of the impellers are compared, and the flow rate regulation command of another impeller of the plurality of impellers is corrected based on a comparison result of a certain impeller of the plurality of impellers, and wherein when a flow rate of the certain impeller is smaller than the set point, the control step controls the flow rate regulation step to reduce the flow rate of the another impeller and fix the flow rate of the certain impeller to a set value by fixing the flow rate regulation command of the certain impeller and regulating the flow rate regulation command of the another impeller.

* * * * *